United States Patent [19]

Jaquish

[11] 4,037,756

[45] July 26, 1977

[54] DISPLAY-DISPENSER RACK

[75] Inventor: John Jaquish, New York, N.Y.

[73] Assignee: Trans World Display Corporation, New York, N.Y.

[21] Appl. No.: 697,884

[22] Filed: June 21, 1976

[51] Int. Cl.[2] ..... A47F 1/00

[52] U.S. Cl. ..... 221/242; 312/42

[58] Field of Search ..... 221/262, 251, 92, 242; 312/42, 50, 71, 45, 60

[56] References Cited

U.S. PATENT DOCUMENTS

| | | | |
|---|---|---|---|
| 3,674,175 | 7/1972 | Jaquish | 312/42 X |
| 3,887,106 | 6/1975 | Charlson et al. | 312/42 X |
| 3,993,372 | 11/1976 | Mihos | 312/42 |

*Primary Examiner*—Stanley H. Tollberg
*Attorney, Agent, or Firm*—Alan H. Levine

[57] ABSTRACT

A display-dispenser rack for maintaining in exposed view, a variety of differently sized articles for selective dispensing of one or more of the displayed articles. The rack comprises a plurality of vertically extending open front compartments defined by a bottom wall, a rear wall, and spaced vertically extending side walls. A flange is formed preferably on each compartment side wall at the front of the compartment, with the flange extending partially over the front of the compartment to retain an article in the compartment exposed for view through the space adjacent the flange. The flange does not extend to the bottom of the compartment, leaving an opening permitting selective withdrawal of one or more of the lowermost articles in the compartment. A selectively positionable rear spacer member formed with a spring leg is provided for positioning within the compartment to permit selective variation of the depth of the compartment from front to rear to accommodate differently sized articles, and an adjustable stop is provided, preferably for positioning in channels formed in the flanges, with the stop selectively positionable to vary the height of the discharge opening beneath the flanges at the front of the compartment.

9 Claims, 8 Drawing Figures

FIG. 6
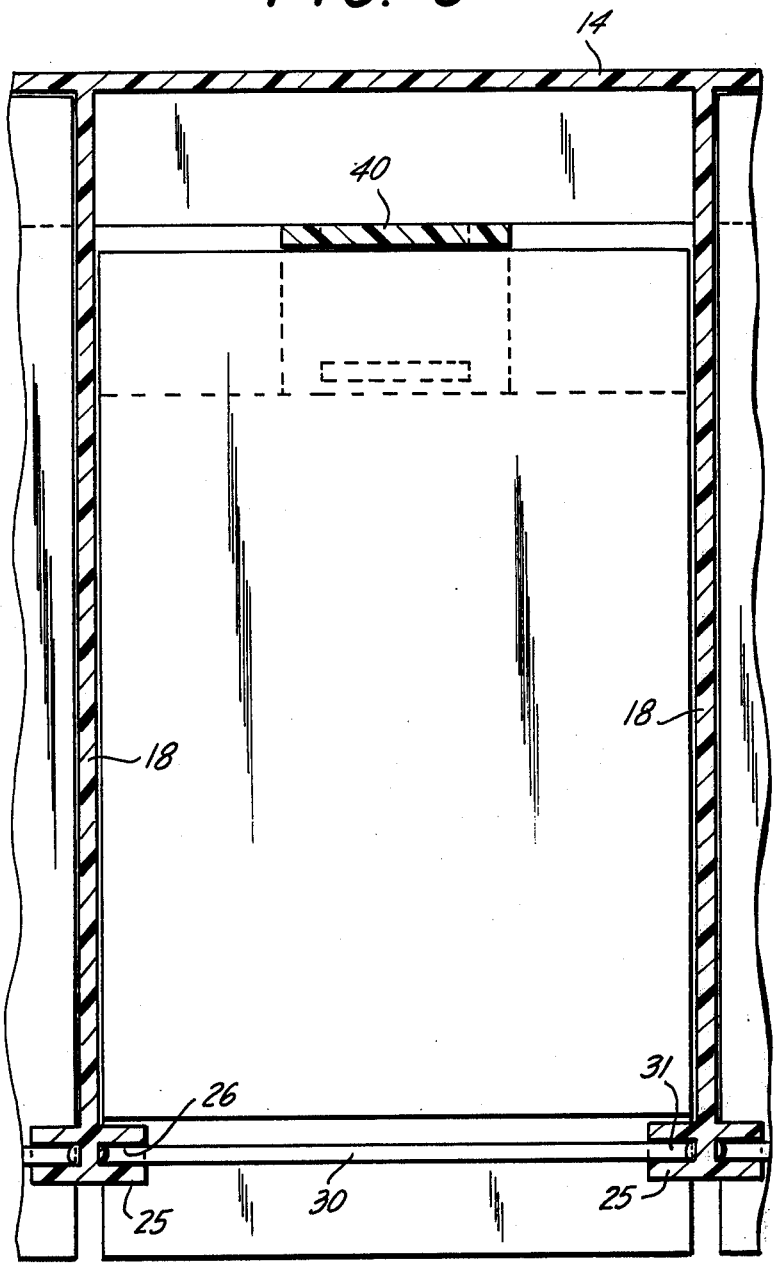
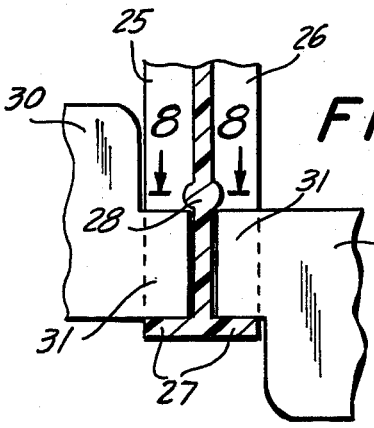
FIG. 7
FIG. 8
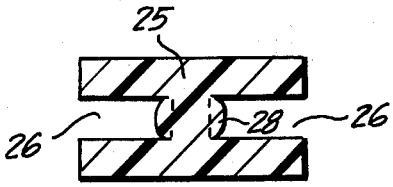

DISPLAY-DISPENSER RACK

BACKGROUND OF THE INVENTION

This invention relates to the art of display-dispenser racks for maintaining in exposed view for selective dispensing, a variety of differently sized articles, and more particularly to a display-dispenser rack which accommodates for diaplay one or more stacks or articles or packages, with different stacks containing articles or packages of different size, permitting the rack user to select an article or package such as a photographic film package or the like from the rack, with the rack selectively adjustable to accommodate differently sized articles.

A variety of different racks have in the past been evolved for displaying stacks of differently sized packages of merchandise, and such racks have been provided with means for selectively varying the capacity of the rack to accommodate differently sized merchandise as needs arise. Thus, in U.S. Pat. No. 3,674,175, issued July 4, 1972, a display-dispenser rack has been provided for storage and display of a variety of stacks of differently sized film packages, with the rack subject to adjustment to accommodate differently sized packages.

It is with display-dispenser racks of the above mentioned type that the instand invention is concerned, with a view to improving such racks to reduce their cost of production, and to improve the facility with which they may be used, and minimize maintenance requirements.

It is thus an object of the present invention to provide an improved display-dispenser rack serving to maintain a plurality of articles or packages of merchandise for ready view by a potential consumer, with one or more of the displayed packages subject to selective removal from the rack.

A further object of the invention is to provide a display-dispenser rack in which the articles or packages of merchandise are retained in the rack in a fashion such that only the desired number of such articles or packages intended for removal at any given time are presented in a position for removal by a user.

An additional object of the invention is to provide a display-dispenser rack in which the height of the dispensing orifice through which articles are dispensed from the rack may be selectively varied to accommodate differently sized articles or packages, or different numbers of articles or packages for simultaneous dispensing.

It is an additional object of the invention to provide a display-dispensing rack having merchandise retaining compartments which are readily adjustable in size to accommodate differently sized packages of merchandise.

A further object of the invention is to provide a display-dispenser rack in which the need for cleaning a viewing window is eliminated.

These and other objects of the invention which will become hereafter more apparent are achieved by forming a displaydispenser rack with at least one, and preferably a plurality of, vertically extending open front elongate compartments with each compartment having a rear wall, spaced side walls, and a bottom wall. In the preferred embodiment, a top wall is also provided, and a plurality of compartments are arranged in side by side orientation, with a common front plane. A flange is formed on at least one side wall of each compartment at the front thereof, with the flange extending partially along the front of the compartment to retain any articles or packages of merchandise in the compartment, but leaving a free opening so that the contents of the compartment may be readily observed. The flange does not extend down to the bottom of the compartment, thus leaving a free opening at the bottom of the front of the compartment through which an article or package may be dispensed, and preferably does not extend to the top of the compartment to leave a free opening for insertion of articles or packages into the compartment. The size of the dispensing opening is made selectively variable by means of an adjustable stop comprising a plate member having an ear which rides in a channel formed in the flange. The plate member extends down from an edge of the ear, and the stop may be positioned with the uneared portion of the plate up or down, so that the upper limits of the dispensing opening may be varied. In order to permit selective variation of the front to back depth of the compartment, a rear spacer, comprising a plate-like member is provided with a spring leg and engaging toe for securing the spacer at a selective position within the compartment. The spacer and the rear wall are both formed with discharge ramps at the lower end of the compartment to urge the gravity fed stack of packages within the compartment to a dispensing position for selective removal.

A feature of the invention resides in the formation of the rear spacer with at least a portion thereof resilient so as to permit the spacer to be snapped into position in the compartment. This is preferably accomplished by forming the spacer of a resilient material, additionally provided with a spring leg to provide desired resilience.

An additional feature of the invention resides in the selectively adjustable front stop in which a single stop member may be employed to selectively vary the dispensing opening.

A further feature of the invention resides in the utilization of a channeled flange at the front of the compartment, with the channel provided with a resilient detent serving to retain the stop member in desired position.

Another important feature of the invention resides in the fact that there is no front wall, thus eliminating the need to clean any window areas to provide a clear view of the rack contents.

BRIEF DESCRIPTION OF THE DRAWINGS

The speciific details of a preferred embodiment setting forth the best mode contemplated by the inventor for practicing the invention, and the manner and process of making and using same, will be described in full, clear, concise and exact terms, so as to enable those skilled in the art to make and use same in conjunction with the accompanying drawings, wherein:

FIG. 6 is an enlarged cross-sectional view on a horizontal plane through line 6—6 on FIG. 5, looking down at the bottom of the compartment;

FIG. 7 is an enlarged detail view on line 7—7 on FIG. 1, with the flange shown in vertical cross-section, and illustrating the detent implementing securement of the adjustable stop in the flange channel; and FIG. 8 is an enlarged cros-sectional view on line 8—8 on FIG. 7, showing the channel in the flange with the elastic detent.

DESCRIPTION OF PREFERRED EMBODIMENT

Referring now more particularly to the drawings illustratively showing a preferred embodiment of the invention, like numerals in the various FIGS. will be employed to designate like parts.

Figure 1:
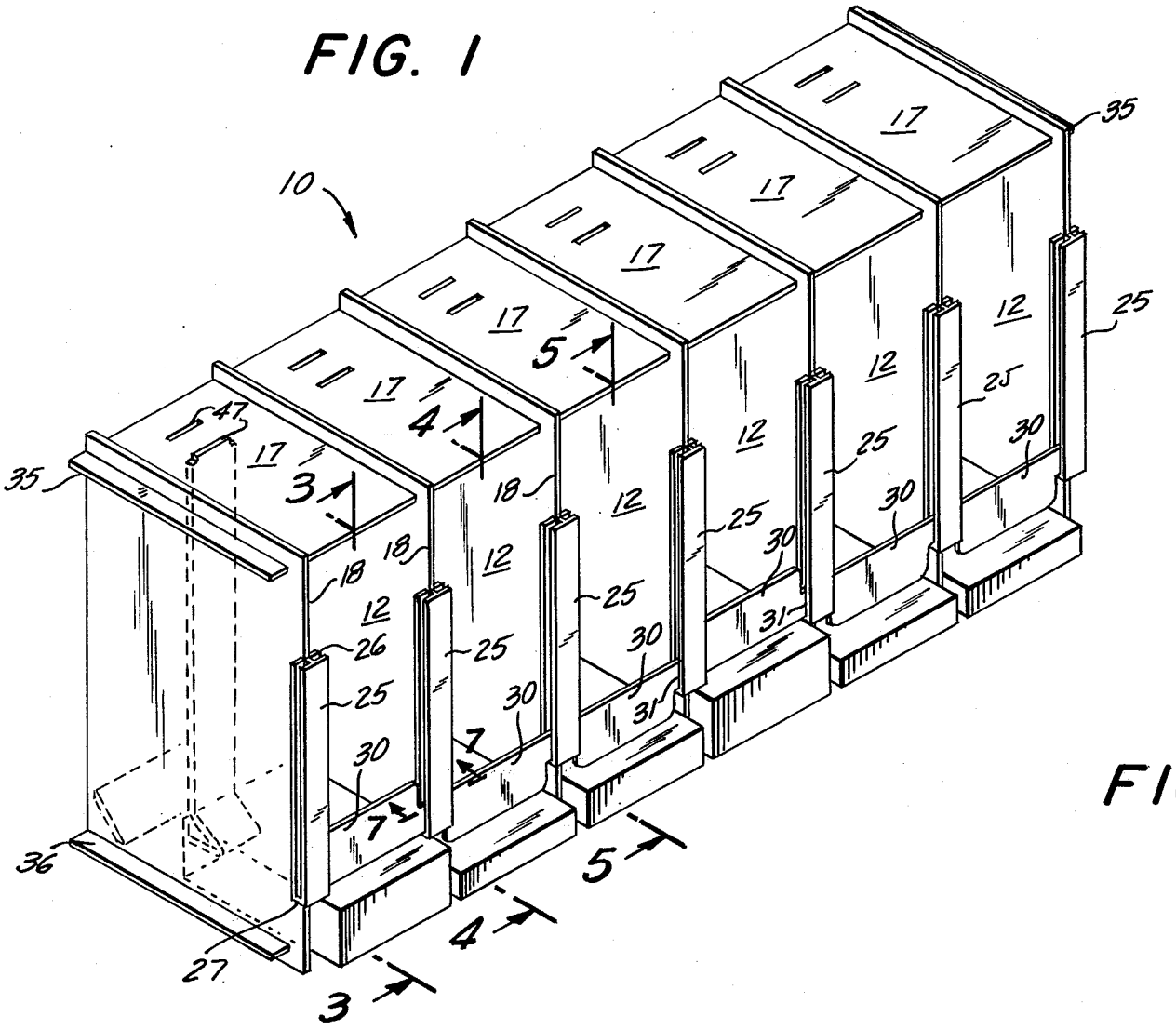
FIG. 1 is a perspective front elevational view of a display-dispenser rack made in accordance with the invention.

As illustratively shown in FIG. 1, the displaydispensing rack 10 is seen to comprise a plurality of box-like compartments 12, six of which are shown in the illustrated embodiment, it being understood by those skilled in the art, that the number of compartments may be varied from one compartment up to as many as may be suitably accommodated in a desired space.

Figure 5:
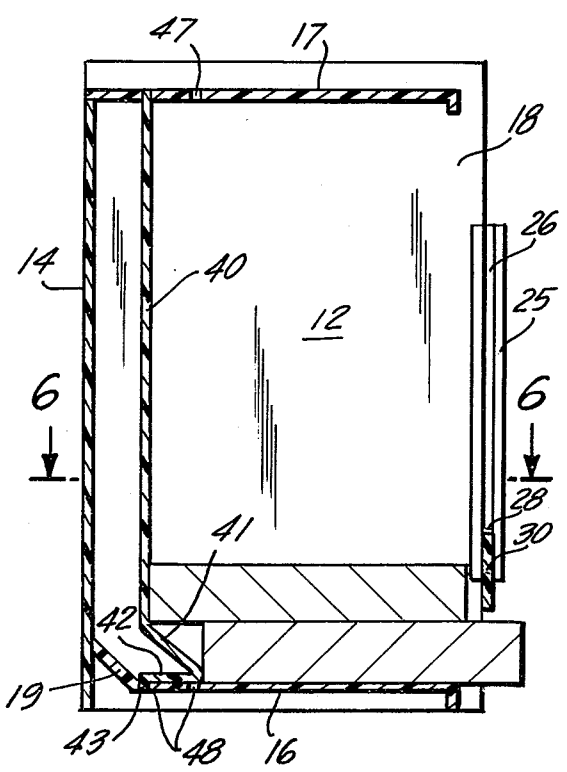
FIG. 5 is an enlarged cross-sectional view taken on a plane through line 5—5 viewed in the direction of the arrows showing the orientation of the compartment components for retaining packages intermediate in height and depth to the packages shown in FIGS. 3 and 4.
Figure 4:
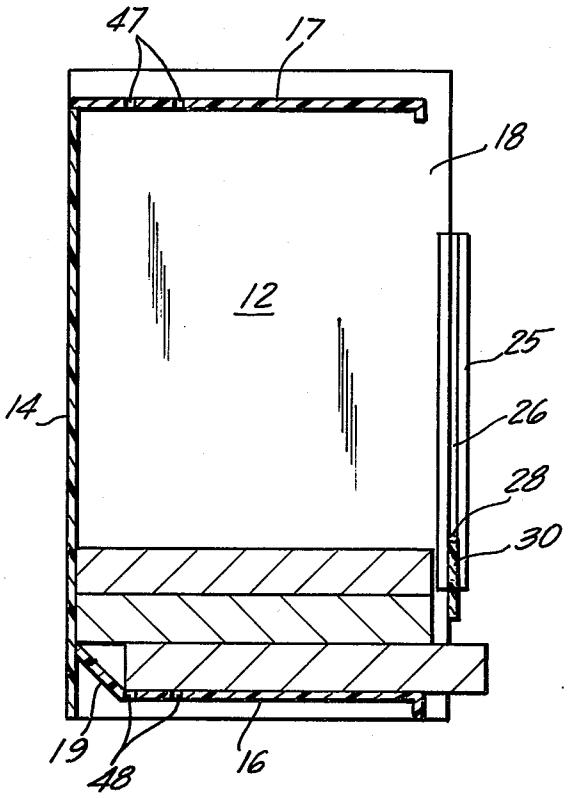
FIG. 4 is an enlarged cross-sectional view taken on a vertical plane through line 4—4 on FIG. 1 viewed in the direction of the arrows showing relatively thinner packages with greater front to back depth than the packages shown in FIG. 3 in position in a compartment of the rack.
Figure 3:
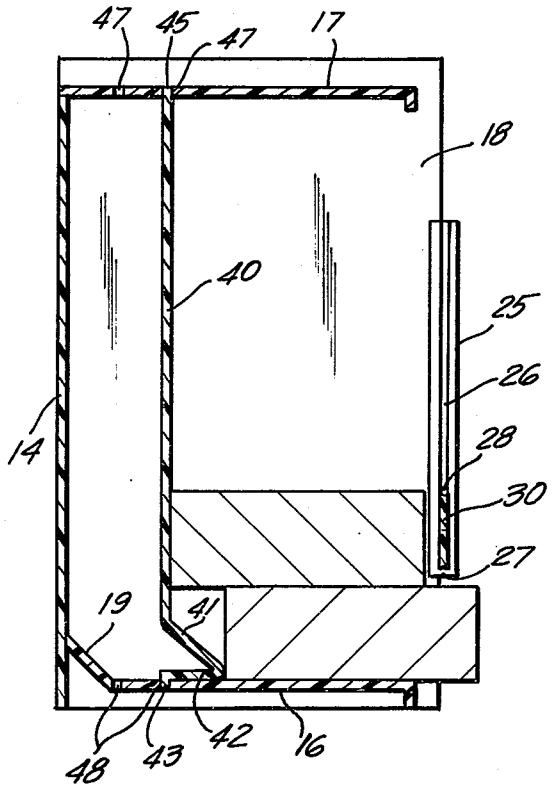
FIG. 3 is an enlarged cross-sectional view taken on a vetical plane through line 3—3 on FIG. 1 viewed in the direction of the area showing the orientation of relatively thick packages of relatively small front to back depth in position in a compartment of the rack.

Each compartment 12 is of a box-like configuration preferably rectangular in vertical and horizontal cross-section, and formed with a rear wall 14, bottom 16 and top wall 17, as best seen in FIGS. 3-5. Each compartment 12 is further defined by spaced side walls 18, as best seen in FIGS. 1 and 6. In the illustrated embodiment, as seen in FIG. 1, where a plurality of compartments are employed, a single side wall 18 may satisfactorily be employed as a common wall between adjacent compartments. A dispensing guide 19, in the form of an inclined ramp, is formed between the bottom of the rear wall 14 and the back of bottom wall 16, as best seen in FIGS. 3-5.

Secured to the front edge (the edge opposite rear wall 14) of at least one of each side wall 18, defining a compartment, is a flange 25. In the illustrated embodiment, as best seen in FIGS. 1 and 6, a flange 25 is secured on each side wall of each compartment. In accordance with the invention, the flange 25 is preferably of an H-shaped configuration in cross-section, as best seen in FIGS. 6 and 8 with a pair of the legs of the flange 25 extending away from each side wall to which the flange is secured, or on which the flange is formed. The H-shaped configuration of the flange 25 serves to provide a channel 26 in the flange for a purpose to become hereinafter more apparent. Flange 25 is formed of a dimension, and arranged with respect to the side wall, so that the flange extends only partially over the front of the compartment defined by the side wall 18, thus leaving an opening at the front of the compartment of sufficient dimension to permit ready perception of the contents of the compartment, and at the same time functions to retain any articles or packages contained within the compartment, it being understood that the dimensions of the compartment are such as to slidingly accommodate a stack of rectangular packages or articles desired to be displayed and dispensed therefrom. Each flange 25 is of a length such that it may be positioned or formed on the side wall to leave a clear opening between compartment side walls at the top and bottom of the compartment of sufficient area to freely pass at least one of the thickest (highest as viewed in the drawings) of the packages to be displayed and dispensed from the compartment, as best seen in FIGS. 1 and 3-5. The lower and of the flange channel 26 is closed as at 27 as best seen in FIGS. 1 and 7, and a resilient detent 28 is formed in the channel, as shown in FIG. 7, for a purpose to be hereinafter described. The resilience of the detent is most readily attained by fabricating the channel of a plastic material, such as polyvinyl or the like.

An adjustable positionable dispensing opening limiting stop 30, as best seen in FIG. 1, is provided for adjustable engagement with flange 25 at the lower end of the flange to permit selective variation of the height of the dispensing opening from the rack compartment 12. The stop 30 is formed of a plate, as best seen in FIG. 1, having ears 31 extending from the lateral edges of the plate along only a portion thereof, so that as viewed in FIGS. 1 and 7, the plate 30 extends vertically from the ear 31 at a greater distance on one edge of the ear than the other. In the illustrated embodiment, plate 30 only extends vertically from one edge of the ear, thus leaving an eared and uneared portion. The stop 30 with ears 31, as illustrated, is formed of a dimension such as to extend across the front of compartment 12, with the ears 31 accommodated in the channels 26 of flanges 25. The height of the ear 31, as best seen in FIG. 7, is preferably such as to extend between closed channel end 27, and detent 28. As illustrated, the stop 30 may be arranged with the uneared part of plate 30 extending upwardly, as shown to the left in FIGS. 1 and 7, or downwardly, as shown to the right in FIGS. 1 and 7.

In the illustrated embodiment of the rack 10, upper handle strips 35, and lower handle strips 36 are shown as provided on the exterior surfaces of the lateral side walls 18 of the rack. As illustrated, these handles provide a decorative as well as utilitarian function, enhancing appearance, and permitting gripping of the rack to facilitate movement of an assembled rack.

Figure 2:
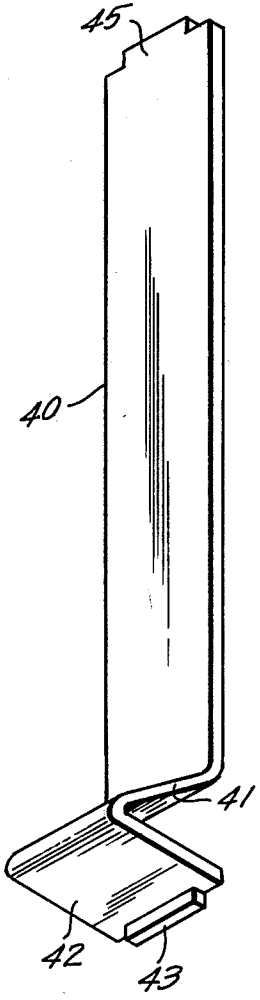
FIG. 2 is a perspective elevational view of the rear spacer employed for selectively varying the front to back depth of the compartments of the display-dispenser rack.

In order to permit selective variation of the front to back depth of the compartments 12 so as to permit to rack to be utilized for stacks of differently sized packages or articles, a selectively positionable rear spacer 40 is provided, as best seen in FIGS. 2-5. Rear spacer 40 as seen in FIG. 2 comprises an elongate strip of material formed with a spring leg 41 at the lower end thereof, resiliently secured to the vertically extending strip. Spring leg 41, as best seen in FIGS. 3 and 5, is contoured like dispensing ramp 19, and when the spacer is used, acts like ramp 19 to urge the lowermost article or package to a dispensing position. A horizontal foot 42 is resiliently coupled to the spring leg 41, and an engaging toe 43 is formed at the face end of foot 42, as best seen in FIG. 2. The upper end of spacer 40 is formed with an upper engaging finger 45. The spacer 40 is preferably dimensioned of a width approximately one-third that of the width of the compartment 12, and of a length substantially equal to the distance between the upper and lower surfaces of top wall 17 and bottom wall 16 respectively, as best seen in FIGS. 3 and 5, the space length being such that finger 45 and toe 43 may be engaged with top wall 17 and bottom wall 16, respectively.

Each compartment top wall 17 is provided with one or more spaced spacer finger engaging slots 47, as best seen in FIGS. 1 and 3–5 extending parallel to the rear wall 14 and of a dimension such as to freely accommodate spacer lip 45. Bottom compartment wall 16 is formed with similar spacer finger engaging slots 48 dimensioned to accommodate spacer toe 43, with slots 48 extending parallel to rear wall 14, as best seen in FIG. 6. The spacer 40 is preferably formed of resilient material, and as will be hereinafter more fully described, is designed to be snapped into position with the finger 45 and toe 43 engaging between top wall 17 and bottom wall 16 respectively, as best seen in FIGS. 3 and 5, to permit selective variation of the front to back of the compartment 12.

OPERATION

The illustrated preferred embodiment of the rack 10 may be fabricated of a variety of sheet materials utilizing conventional sheet forming techniques. An eminently satisfactory structure, as illustrated, has been developed utilizing sheet plastics of the currently available types, with the sheet top wall 17, and side walls 18, in the contours as illustrated in the drawings. The sheet components are then fastened by glueing or the like into the illustrated assembly. As will be understood by those skilled in the art, a variety of plastic molding techniques may also be utilized in forming a rack of the desired contours with the wall components molded integrally. The flanges 25 of the desired H configuration are preferably formed of a resilient plastic material. This may satisfactorily be done from extruded lengths of H-shaped stock with a closed channel end 27 formed by securing a plastic plate at the lower end of the extrusion, as seen in FIG. 7, and a resilient vinyl button secured to the web of the flange stock to form detent 28. Alternatively, the flanges may be molded by conventional plastic molding techniques of a resilient stock.

After the components as illustrated and above described are formed, they are assembled in the configuration illustrated in FIG. 1. In use, the rack which is formed with one or more compartments dimensioned in horizontal cross-section to accommodate the largest of the packages or articles to be displayed and dispensed has one or more of its compartments filled with such articles or packages. The clearance between the bottom of the flange 25, and the top surface of bottom wall 16, as best seen in FIG. 3, is selected to be such as to freely pass the desired number of the lowermost articles or packages in the stack of articles contained within the compartment, it being understood that in most instances, as illustrated, a single article or package will be dispensed at a time.

Stop 30 is arranged in the channel with the uneared portion of the plate forming stop 30, extending upwardly, thus providing a dispensed opening of maximum height permitting dispensing of the thickest (highest as viewed in the drawings) article of merchandise, which is to be handled, such relatively thick article shown by way of example in FIG. 3. It will be noted, as best seen in FIG. 7, that when the stop plate is positioned in flange channel 26, ear 31 is held against vertical slippage by detent 28. The stop is preferably slid into channel 26 from the top and forced past detent 28 to a position seated on closed lower channel end 27.

Where a package or article having a height less than the maximum dispensing opening is to be dispensed, the stop member 30 is removed from the channel and reversed, so that the uneared part of the place extends downwardly, as viewed in FIG. 4. It has been found that by dimensioning the plate with the uneared portion extending downwardly from its seating position in the flange channel, as viewed in FIG. 7, a distance less than the height of two of the articles or packages contained within a compartment, a plurality of different heights or thickness of article, as viewed in FIGS. 4 and 5, may be accommodated utilizing the same stop. The dimensioning of the stop, and the positioning of the flanges is obviously selected to accommodate the range of depths or thickness of the article or package to be dispensed.

As best seen in FIGS. 3–5, the dispensing of the lowermost articles of the stack of articles or packages contained within the compartment 12 is facilitated by the dispensing ramp 19 between rear wall 14 and bottom wall 16, or the angulation of spring leg 41 when the spacer 40 is employed. As best seen in FIGS. 3–5, the angulation of the ramp 19 or leg 41 is such that as the gravity fed stack of articles contained within the compartment 12 is forced downwardly by the weight of the superposed articles or packages in the compartment, the lowermost article or package is forced by the ramp out through the dispensing opening between the top surface of bottom wall 16 and the bottom of flange 25, to the position illustrated in FIGS. 3–5, so that the lowermost article of the stack or articles or packages contained in the compartment is available for manual gripping for selective removal from the compartment.

Where the front to back depth of the article or package contained in the compartment is to be varied, the front to back depth of the compartment may be varied by the utilization of rear spacer 40, which, as best seen in FIGS. 3 and 5, is snapped into position at a selected distance from the rear wall 14 by positioning engaging finger 45 in the selected slot 47 in the compartment top wall 17, springing spring leg 41 and moving the spacer 40 back to engage engaging toe 43 in slot 48 in bottom wall 16, so as to securely maintain the spacer in a desired vertical plane spaced from the rear wall of the compartment.

The width of the packages or articles contained in the compartments is such that the packages or articles extend substantially between the compartment side walls 18 and are retained in the compartment by the flanges 25 overlapping a portion of the front of the compartment. However, as best seen in FIG. 1, the contents of the compartment are readily visible.

It will be noted that there is a reduction in material required, since conventionally employed front walls are not provided, and the problem of cleaning and maintaining a transparent front wall window to permit viewing to the compartment is eliminated. The display-dispenser rack is subject to ready fabrication, and is eminently suitable for displaying and dispensing a variety of articles, and more particularly photographic film to permit a retailer to stock a plurality of differently sized film packages, and to very the stock in response to seasonal requirements, where daylight film stocks may be greater during the warmer months, requiring a variation in the quantities of film of one type as compared to another.

The above disclosure has been given by way of illustration and elucidation, and not by way of limitation, and it is understood that the invention may be embodied in a variety of different forms within the scope of the appended claims.

What is claimed is:

1. A display-dispenser rack for maintaining in exposed view for selective dispensing, a variety of differently sized articles, said rack comprising:

a compartment having a vertical rear wall, spaced vertical side walls, and a bottom wall;

a flange on at least one of the vertical side walls of said compartment extending in a vertical plane partially over the front of said compartment, leaving an opening at the front of said compartment exposing the contents of said compartment to view, said flange spaced from the bottom wall of said compartment a distance at least equal to the height of a single one of the largest articles to be held in and dispensed from said compartment; and a vertically extending rear spacer member selectively positionable in said compartment at a spaced distance from the rear wall of said compartment to constrain the articles in said compartment toward said flange, said rear spacer member comprising a vertically extending plate member; a spring leg resiliently joined to a lower end of said spacer and angled to extend down toward the front of said compartment to displace the lowermost article in the compartment to a dispensing position; and a toe joined to said leg, said toe engaging in an opening in the bottom wall of said compartment.

2. A display-dispenser rack as in claim 1, having a stop member extending across the front of said compartment and said top member adjustably engageable with said flange at a selected position at the lower end of said flange to limit the height of the opening between the bottom of the flange and the bottom wall of said compartment to permit an article of a given height to be removed from said compartment.

3. A display-dispenser rack as in claim 2, in which said stop member comprises a plate extending across the front of said compartment; and an ear on said plate engageable with said flange, said stop plate extending vertically from said ear a greater distance on one edge of said ear than the other, whereby depending on the orientation of said plate, a smaller or larger opening will be provided at the front of said compartment beneath said flange through which an article in said compartment may be dispensed.

4. A display-dispenser rack as in claim 3, in which said flange is formed with a channel; and said ear on said stop member plate is slideable in the channel.

5. A display-dispenser rack as in claim 4, in which an elastic detent is formed in said channel locking said ear on said stop plate in a selected orientation in said channel.

6. A display-dispenser rack as in claim 1, having a horizontal foot between said spring leg and said toe.

7. A display-dispenser rack as in claim 6, in which said rack comprises a top wall having at least one slot at a spaced distance from the rear wall of said compartment; and an engaging finger on the upper end of said rear spacer for engagement in the slot of the top wall.

8. A display-dispenser rack as in claim 1, in which said rack comprises a plurality of compartments arranged adjacent each other with common vertical side walls between adjacent compartments; flanges on each vertical wall; and spacers in each compartment.

9. A display-dispenser rack for maintaining in exposed view for selective dispensing, a variety of differently sized articles, said rack comprising:

a. a plurality of elongate, vertically extending compartments arranged adjacent each other with common vertical side walls between adjacent compartments, each compartment having a rear wall; a bottom wall extending in a horizontal plane from said rear wall and having a slot at a spaced distance from said rear wall in a plane parallel thereto; and a top wall extending from said rear wall extending in a plane parallel thereto;

b. a flange on each of the side walls of said compartments, said flange extending in a vertical plane partially over the front of said compartment, leaving an opening at the front of said compartment exposing the contents of said compartment to view, said flange spaced from the bottom wall of said compartment at a distance at least equal to the height of a single one of the largest article to be held in and dispensed from said compartments, said flange spaced from the top wall of the compartment with which it is associated at a distance equal at least to the height of the largest article to be held in said compartment; and a channel formed in said flange;

c. a stop member comprising a plate of a size to extend across the front of one of said compartments between said flanges; ears extending from said plate over a part off the length of the edge of the plate, leaving a portion of the plate uneared, and a portion eared, said ear dimensioned to fit freely within said channel of said flange;

d. a detent in said channel retaining said plate in position in said channel; and e. a rear spacer member comprising a vertically extending plate member; a spring leg resiliently joined to a lower end of said spacer, said spring leg inclined with respect to the vertical plane of said spacer to provide a dispensing ramp; a horizontal foot resiliently secured to said spring leg; an engaging toe at the free end of said leg adapted for engagement in the slot in the bottom wall of said compartment; and a finger at the upper said spacer engageable in the slot in the top wall of said compartment.

* * * * *